US005215548A

United States Patent [19]

Ashcraft et al.

[11] Patent Number: 5,215,548

[45] Date of Patent: Jun. 1, 1993

[54] DISTILLATE FUELS CONTAINING AN AMINE SALT OF A SULFONIC ACID AND A LOW VOLATILITY CARRIER FLUID (PNE-554)

[75] Inventors: Thomas L. Ashcraft, Scotch Plains; Alan M. Schilowitz, Highland Park, both of N.J.; Larry D. Talley, Friendswood, Tex.; Paul J. Berlowitz, East Windsor, N.J.

[73] Assignee: Exxon Research and Engineering Company, Florham Park, N.J.

[21] Appl. No.: 811,409

[22] Filed: Dec. 20, 1991

[51] Int. Cl.[5] ..... C10L 1/22; C10L 1/24

[52] U.S. Cl. ..... 44/372; 44/389

[58] Field of Search ..... 44/370, 372, 389

[56] References Cited

U.S. PATENT DOCUMENTS

| | | | |
|---|---|---|---|
| 2,582,733 | 1/1952 | Zimmer et al. | 44/372 |
| 2,764,548 | 9/1956 | King et al. | 44/370 |
| 2,845,393 | 7/1958 | Uarvel | 44/372 |
| 2,930,681 | 3/1960 | Barusch | 44/370 |
| 3,005,847 | 10/1961 | Bray | 44/372 |
| 3,578,422 | 5/1971 | Dover, Jr. | 44/372 |

*Primary Examiner*—Jacqueline V. Howard

*Attorney, Agent, or Firm*—John W. Ditsler; James H. Takemoto

[57] ABSTRACT

Distillate fuel compositions containing an amine salt of a sulfonic acid and a low volatility carrier fluid are effective in reducing the formation of intake valve deposits in internal combustion engines. Gasoline containing diamine salts in combination with a polyol ester carrier fluid is a particularly preferred distillate fuel composition.

9 Claims, No Drawings

DISTILLATE FUELS CONTAINING AN AMINE SALT OF A SULFONIC ACID AND A LOW VOLATILITY CARRIER FLUID (PNE-554)

BACKGROUND OF THE INVENTION

1. Field of the Invention

This invention relates to a distillate fuel composition containing an oil soluble amine salt of a sulfonic acid and a low volatility carrier oil, and its use to reduce the formation of intake valve deposits in an internal combustion engine.

2. Description of Related Art

Various sulfonate salts have been used to reduce deposits in internal combustion engines. For example, U.S. Pat. Nos. 2,989,387 and 2,989,564 disclose that hydrocarbyl 1,3 diaminopropane sulfonates inhibit the formation of deposits when added to fuel and lubricating oils. U.S. Pat. No. 2,764,548 discloses that a fuel additive containing dinonyl naphthalene sulfonic acid salts (including ammonium and amine salts) provides lubrication at the tops of cylinders and at the valve stems. U.S. Pat. No. 2,995,427 describes an oil soluble ammonium sulfonate that prevents water accumulation in gasoline. U.S. Pat. No. 2,923,611 discloses that alkylene polyamine salts of either petroleum sulfonic acids or synthetic alkylated aromatic sulfonic acids are effective middle distillate fuel stabilizers. DS 1,545,248 discloses the use of oil and water soluble amine sulfonate salts as corrosion inhibitors in middle distillate fuels. U.S. Pat. No. 3,578,422 discloses the use of oil soluble ammonium or amine sulfonates to prevent or reduce water emulsion formation in petroleum distillate fuels. U.S. Pat. No. 3,785,790 discloses the use of polyisobutenyl N,N-dialkyl propylene 1,3-diamine alkylaromatic sulfonates to inhibit fouling in gasoline engines. U.S. Pat. No. 4,182,765 discloses a fungicide in oil products derived from the reaction of a quaternary ammonium salt and an alkyl benzene sulfonic acid. European Patent Application having Publication No. 0 261 957 discloses the use of a specific class of sulfonate salts as wax crystal modifiers for distillate fuels.

However, none of these patents suggest the particular synergistic fuel composition disclosed below or its effectiveness in reducing the formation of intake valve deposits in an internal combustion engine.

SUMMARY OF THE INVENTION

In one embodiment, this invention relates to a distillate fuel composition comprising a major amount of gasoline and a minor synergistic amount of an additive combination of (a) an amine salt of a sulfonic acid, and (b) a carrier fluid that is a mineral oil basestock, a polyol ester, or mixtures thereof, wherein less than 10 volume % of the carrier fluid is vaporized at a temperature of 125° C.

In another embodiment, this invention concerns a method for reducing intake valve deposits in an internal combustion engine by operating the engine with the composition described above. In yet another embodiment, this invention concerns a fuel additive concentrate containing the above additive combination.

DETAILED DESCRIPTION OF THE INVENTION

This invention concerns a distillate fuel composition containing a) an oil soluble amine salt of a sulfonic acid and b) a low volatility carrier oil. More specifically, we have discovered that a distillate fuel containing a major amount of gasoline and a minor amount of a synergistic combination of an oil soluble amine salt of an alkylaromatic sulfonic acid and a low volatility carrier oil can reduce the formation of intake valve deposits in internal combustion engines. The combination of the two components provides unexpectedly better performance than either of the components alone. Diamine salts in combination with a low volatility polyol ester or mineral oil carrier fluids are particularly preferred.

The sulfonic acid salts of this invention are generally derived by reacting sulfonic acids of synthetic or petroleum alkyl aromatics with alkyl amines or alkyl polyamines. Petroleum sulfonic acids can be obtained by the treatment of a middle distillate petroleum fraction containing alkyl aromatic hydrocarbons with concentrated sulfuric acid or oleum. Synthetic sulfonic acids such as those obtained by acid or gaseous $SO_3$ treatment of alkyl aromatic hydrocarbons prepared by alkylating benzene, toluene, naphthalene and similar aromatics with an olefin such as polypropylene containing from about 4 to about 100 carbon atoms per molecule may also be used. A synthetic sulfonic acid prepared in this manner (which is well known in the art) that has been found to be particularly effective is polypropyl benzyl sulfonic acid.

A variety of alkyl amines may be used for neutralizing the sulfonic acids described above. Mono amines and polyamines may be used. The amine or polyamine may contain from 2 to 100 carbon atoms and from 1 to 3 nitrogen atoms. The hydrocarbyl group may be derived from polymerization of olefins such as butylene and propylene. Preferred polyamines contain 2 nitrogens and from 2 to 50 carbon atoms (e.g. ethylene diamine, propane diamines, and the like). Especially preferred polyamines are diamines containing from 3 to 26 carbon atoms. The amines may contain ether linkages.

Examples of preferred amine sulfonic acid salts are the reaction product of an alkyl benzyl sulfonic acid in which the alkyl group contains from 20 to 50 carbon atoms with one of the following: octadecyl amine, 1,2 propane diamine, an amine of the formula $$R—O—R_1—NR_2—R_3—NR_4R_5$$

or the formula $$R—O—R_1—NR_4R_5$$

where

R is an aliphatic group containing from to 26 carbon atoms, $R_1$ is an aliphatic group containing from 1 to 10 carbon atoms, $R_2$, $R_4$, and $R_5$ may be the same or different and are hydrogen, methyl, or ethyl, $R_3$ is an alkyl group containing from 2 to 6 carbon atoms.

Particularly preferred sulfonic acid salts are the reaction product of an alkyl benzyl sulfonic acid in which the alkyl group contains from 24 to 45 (most preferably 24) carbon atoms with 1,3 propane diamine.

The carrier fluid may be derived from several sources, including being blended from several components. It should have a relatively low volatility, with less than 10 volume % of the carrier fluid being vaporized at a temperature of 125 C. The carrier fluid can be generally hydrocarbyl in nature, and may include oxygencontaining species such as ethers, esters, and hydroxyls. Suitable carrier fluids include mineral oil base stocks as well as synthetic base oils. Preferred carrier fluids are mineral oil and polyol ester basestocks having a kinematic viscosity at least 4 centistokes at 100° C. Especially preferred carrier fluids are mineral oil base stocks containing less than 10 wt.% aromatics (as measured by silica gel extraction) and polyol ester base stocks containing at least 20 carbon atoms with 3 ester groups per molecule. Both synthetic and naturally occurring polyol esters may be used.

The alkyl amines (or polyamines) and sulfonic acids may be reacted in approximately theoretical proportions as determined by the acid number of the sulfonic acid. The reactants may be stirred and heated to insure complete reaction. At the end of reaction the sample may be filtered and any volatile solvents removed by evaporation.

The distillate fuels of this invention will, in general, comprise a maJor amount of gasoline and a minor synergistic amount of the sulfonate alkyl amine salt and the carrier fluid. However, the precise amount and ratio of the sulfonate salt and carrier fluid can vary broadly. As such, only an amount effective or sufficient to reduce the formation of engine intake system deposits need be used. Typically, however, the amount of the sulfonate salt will range from about 40 to about 1500 ppm, although greater amounts could be used. Preferably, from about 75 to about 600 ppm of the sulfonate alkyl amine salt will be present in the fuel. The amount of carrier fluid will generally range from about 0.1 to about 10 times, preferably from about 0.3 to about 3 times, that of the sulfonate alkyl amine salt (based on weight).

Other additives may be included in the fuel. Examples of such additives include antiknock agents (e.g. tetraethyl lead), other detergents or dispersants, demulsifiers, antioxidants, anticorrosives, and the like.

Although the sulfonate alkyl amine salts and carrier fluid used herein will generally be added to a distillate fuel, they may be formulated as a concentrate using an organic solvent (e.g. a hydrocarbon solvent, an alcohol solvent, or mixtures thereof) boiling in the range of about 165° to about 400° C. Preferably, an aromatic hydrocarbon solvent (such as benzene, toluene, xylene, or higher boiling aromatics or aromatic thinners, and the like) is used. Aliphatic alcohols containing from 3 to 8 carbon atoms (such as isopropanol, isobutylcarbinol, n-butanol, and the like), alone or in combination with hydrocarbon solvents, can also be used with the sulfonate alkyl amine salts and carrier fluid. The amount of sulfonate alkyl amine salt in the concentrate will ordinarily be at least 5 wt. % and, generally, will not exceed about 70 wt. %. The amount of carrier fluid will generally be between 0.1 and 10 times the amount of sulfonate alkyl amine. The amount of solvent will make up the balance of the concentrate.

This invention will be further understood by reference to the following examples, which include a preferred embodiment of this invention.

EXAMPLE 1—SYNTHESIS OF SULFONATE/AMINE SATL

An iso-$C_{24}$ benzene alkylate (PAL-2 available from Exxon Chemical Company) was sulfonated with gaseous $SO_3$ at a treat rate of 0.90 equivalents $SO_3$/mole alkylate. The resulting sulfonic acid was dissolved in petroleum ether. A solution of octadecyl amine (available from Aldrich Chemical Co.) in petroleum ether was added to the sulfonic acid solution at an equimolar ratio of amine to sulfonic acid. The resulting amine sulfonate salt

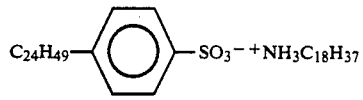

was concentrated by evaporating the petroleum ether.

EXAMPLE 2—SYNTHESIS OF SULFONATE/DIAMINE SALT

An iso-$C_{24}$ benzene alkylate (PAL-2 available from Exxon Chemical Company) was sulfonated with gaseous $SO_3$ at a treat rate of 0.90 equivalents $SO_3$/mole alkylate. The resulting sulfonic acid was dissolved in petroleum ether. A solution of 1,3-diaminopropane (available from Aldrich Chemical Co.) in ethyl ether was added to the sulfonic acid solution at a ratio of one mole of amine to two moles of sulfonic acid. The resulting diamine di-sulfonate salt

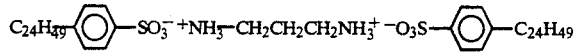

was concentrated by evaporating the solvents.

EXAMPLE 3—REDUCTION OF INTAKE VALVE DEPOSITS WITH ALKYL AMINE SULFONATE SALTS AND CARRIER FLUID

Seven 100 hour test runs were made on a standard mileage accumulation dynamometer using the following fuels in 1987 BMW 325's:

Test 1—an unleaded premium gasoline (93 octane) without any additives

Test 2—a blend of the gasoline used in Test 1 and 500 ppm of Hercolube F, a polyol ester carrier fluid commercially available from Hercules. Hercolube F has a kinematic viscosity of about 9 centistokes at 100.C and less than 1 volume percent is vaporized at 125° C.

Test 3—a blend of the gasoline used in Test 1 and 400 ppm of the compound prepared in Example 1

Test 4—a blend of the gasoline used in Test 1 and 400 ppm of the compound prepared in Example 2

Test 5—a blend of the gasol in Test 1, 400 ppm of the compound prepared in Example 1, and 500 ppm of Hercolube F Test 6—a blend of the gasoline used in Test 1, 400 ppm of the compound prepared in Example 2, and 500 ppm of Hercolube F Test 7—a blend of the gasoline used in Test 1, 500 ppm of the compound prepared in Example 2, and 500 ppm of a low aromatic (less than 10 wt.% aromatics) 500 Neutral mineral lubricating oil basestock.

Following each test, the intake valves were weighed and the weight obtained compared to the weight of the valves before the tests. The difference is the total valve weight. The- result of these tests are shown in Table 1 below.

TABLE 1

| Test | Sulfonate | Conc. ppm | Carrier Fluid | Conc. ppm | Deposits Mg/valve |
|---|---|---|---|---|---|
| 1 | None | — | None | — | 154 |
| 2 | None | — | Hercolube F | 500 | 152 |

TABLE 1-continued

| Test | Sulfonate | Conc. ppm | Carrier Fluid | Conc. ppm | Deposits Mg/valve |
|---|---|---|---|---|---|
| 3 | Example 1 | 400 | None | — | 88 |
| 4 | Example 2 | 400 | None | — | 76 |
| 5 | Example 1 | 400 | Hercolube F | 500 | 34 |
| 6 | Example 2 | 400 | Hercolube F | 500 | 18 |
| 7 | Example 2 | 500 | Solvent 500 N | 500 | 28 |

The data in Table 1 demonstrate that a significant reduction in intake valve deposits is obtained using a combination of sulfonate alkyl amine salts and carrier fluid compared to the deposits obtained using each component alone.

What is claimed is:

1. A distillate fuel composition comprising a major amount of gasoline and a minor synergistic amount of an additive combination of (a) an amine salt of a sulfonic acid wherein the amine moiety is a monoamine, a polyamine, a monoamine or a polyamine containing ehter linkages, or mixtures thereof, said amine moiety containing from 2 to 100 carbon atoms and from 1 to 3 nitrogen atoms, and the sulfonic acid moiety is an alkyl benzyl sulfonic acid in which the alkyl group contains from 20 to 50 carbon atoms, and (b) a carrier fluid that is mineral oil basestock, a polyol ester, and mixtures thereof, wherein less than 10 volume % of the carrier fluid in vaporized at a temperature of 125° C., provided that the amount of component (a) in the fuel composition is from about 40 to about 1500 ppm and the amount of component (b) is from about 0.1 to about 10 times the amount of component (a).

2. The composition of claim 1 wherein the carrier fluid is a mineral oil basestock having a kinematic viscosity of at least 4 centistokes at 100° C.

3. The composition of claim 1 wherein the carrier fluid is a polyol ester basestock having a kinematic viscosity of at least 4 centistokes at 100° C.

4. The composition of claim 1 wherein the amine sulfonic acid salt is the reaction product of an alkylbenzyl sulfonic acid, in which the alkyl group contains from 20 to 50 carbon atoms, with an amine having the formula $$R—O—R_1—NR_2—R_3—NR_4R_5$$

where

R is an aliphatic group containing from to 26 carbon atoms, $R_1$ is an aliphatic group containing from 1 to 10 carbon atoms, $R_2$, $R_4$, and $R_5$ may be the same or different and are hydrogen, methyl, or ethyl, and $R_3$ is an alkyl group containing from 2 to 6 carbon atoms.

5. The composition of claim 1 wherein the amine sulfonic acid salt is the reaction product of an alkyl benzyl sulfonic acid, in which the alkyl group contains from 20 to 50 carbon atoms, with an amine having the formula $$R—O—R_1—NR_4R_5$$

wherein

R is an aliphatic group containing from to 26 carbon atoms, $R_1$ is an aliphatic group containing from 1 to 10 carbon atoms, and $R_4$ and $R_5$ may be the same or different and are hydrogen, methyl, or ethyl.

6. The composition of claim 1 wherein the amine sulfonic acid salt is the reaction product of an alkyl benzyl sulfonic acid, in which the alkyl group contains from 24 to 45 carbon atoms, and 1,3 propane diamine.

7. The composition of claim 1 wherein the distillate fuel is gasoline.

8. A method of reducing the intake valve deposits in an internal combustion engine which comprises operating the engine using the fuel composition of claim 1.

9. An additive concentrate suitable for blending with a distillate fuel to provide a composition for reducing intake valve deposits which comprises an organic solvent, from about 5 to about 70 wt. % of an amine salt of a sulfonic acid, and the carrier fluid of claim 1 wherein the carrier fluid is present in an amount of between 0.1 and 10 times the amount of the amine salt of a sulfonic acid.

* * * * *